United States Patent [19]

Lundy et al.

[11] Patent Number: 4,694,559

[45] Date of Patent: Sep. 22, 1987

[54] EXPANDING ARBOR

[75] Inventors: Allen W. Lundy, Highland; Leonard Kasle, Franklin, both of Mich.

[73] Assignee: Kasle Steel Corporation, Dearborn, Mich.

[21] Appl. No.: 822,818

[22] Filed: Jan. 27, 1986

[51] Int. Cl.[4] ..... B65H 75/24

[52] U.S. Cl. ..... 29/559; 242/68.2; 242/72.1; 279/2 R

[58] Field of Search ..... 29/559; 82/44; 242/72.1, 68.2, 72; 279/2 R

[56] References Cited

U.S. PATENT DOCUMENTS

| | | | |
|---|---|---|---|
| 2,943,807 | 7/1960 | Loop | 242/72.1 |
| 3,552,673 | 1/1971 | Evers | 242/72.1 |
| 3,843,641 | 9/1974 | Level | 242/72.1 |
| 3,881,666 | 5/1975 | Greenhalgh | 242/72.1 X |
| 3,997,176 | 12/1976 | Wyckoff et al. | 242/72.1 X |
| 4,148,444 | 4/1979 | Hehner | 242/72.1 X |
| 4,149,682 | 4/1979 | Gustafson et al. | 242/72.1 |
| 4,284,251 | 8/1981 | Castillo | 242/72.1 X |

FOREIGN PATENT DOCUMENTS

| | | | |
|---|---|---|---|
| 2071535 | 9/1981 | United Kingdom | 279/2 R |

*Primary Examiner*—Howard N. Goldberg
*Assistant Examiner*—T. Ross
*Attorney, Agent, or Firm*—Cullen, Sloman, Cantor, Grauer

[57] ABSTRACT

The present invention relates to an expandable arbor which is removably attached to a standard decoiler mechanism. The expandable arbor has at least two opposed sections, each having an elongated transversely curved outer surface interconnected by a guide and track to the decoiler mechanism. The guide and track convert lateral movement of the decoiler mechanism into radial movement of the sections. The sections are laterally moveable into the axial bore of a coil of material and thereafter expanded by relative movement of the decoiler mechanism between the sections of the expandable arbor. An equalizer is provided to retract and coordinate movement of the sections.

13 Claims, 4 Drawing Figures

EXPANDING ARBOR

BACKGROUND OF THE INVENTION

The present invention relates to an improved decoiler mechanism for use in supporting and decoiling large coils of material, such as for as example, coiled steel. More particularly, the present invention relates to an expanding arbor attachment for use on a standard cone decoiler mechanism which is insertable into and expandable within the axial bore of a coil of material.

Typically, decoiler mechanisms have opposed truncated cone-shaped supports that support a coil and permit material to be unwound. The supports are forced laterally into each end of the bore in the coil until the support is tightly wedged to prevent relative movement. Due to the cone shape, there is only line contact between the support and the coil.

One problem with this system is that several laps of material are crushed by wedging the support into the coil. The crushed material is generally non-salvagable.

A further problem with this system is surface wear on the support from the wedging action and line contact. To alleviate wear, wear plates are used; however, these have to be replaced frequently, requiring the system to be shut down, which is expensive and inefficient.

A still further problem is the necessity of having to occasionally replace the support due to normal wear and tear. When this occurs, the down-time of the system is even greater, averaging eight hours or more, and the loss of production even more expensive.

BRIEF SUMMARY OF THE INVENTION

The present invention overcomes the above problems by providing an expanding arbor that is removably attached to the end of a support and is moved into and expands radially inside the bore in relation to lateral movement of the support. There is no interference with the coiled material, no sliding contact between the surface of the arbor and the coil and a greater distribution of forces along the arbor surface.

The arbor has at least two sections, in the preferred embodiment four sections, that are individually mounted to the support by a guide and track. The guides and tracks permit relative movement between the arbor and support and convert lateral movement of the support into radial expansion of the sections. The sections are insertable into the bore by lateral movement of the support until a stop means is reached which stops further movement of the sections but allows continued movement of the support within the sections until the sections are tightly expanded against the walls of the bore.

To ensure coordinated movement and to retract the sections, an equalizer plate is provided that is slidably received between each guide means and a face plate mounted on each section. A biasing means is positioned between the equalizer and support and biases the equalizer outwardly away from the support. As the support is forced between the sections, the biasing means is compressed and the sections radially slide along the equalizer. After the material is unwound and the stop means released, the biasing means forces the equalizer outwardly away from the support retracting the sections.

A mounting member is provided to removably mount the sections and the equalizer to the truncated end of the support. In the preferred embodiment, the mounting member has either the guides or the tracks spaced equidistantly about its perimeter. In this manner, the expanding arbor can be easily removed for repair and more importantly, after removal, the support can be used until the expanding arbor is repaired, greatly reducing if not eliminating down-time.

Further, since there is no wedging action, material is not destroyed and there is little wear on the arbor surface, reducing maintenance, repair costs and down-time.

Other advantages and meritorious features of the present invention will be more fully understood from the following description, the appended claims and the drawings, a brief description of which follows.

DETAILED DESCRIPTION OF THE PREFERRED EMBODIMENT

Figure 1:
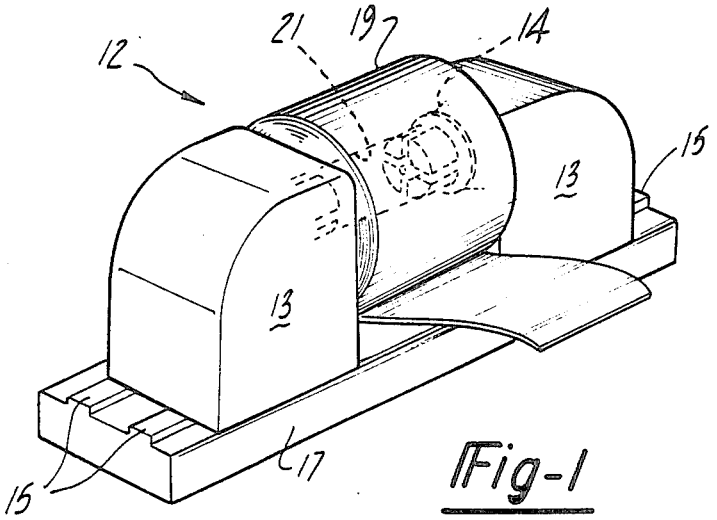
FIG. 1 illustrates a perspective view of a standard decoiler mechanism operatively supporting a coil of material.

With reference to FIG. 1, a standard decoiler mechanism is shown generally at 12 having opposed laterally movable heads 13. As illustrated, heads 13 move along tracks or gibbing 15 within a platform 17 into engagement with a coil of material 19. Typically, coil 19 has an axial bore 21 around which the material is wound. In a standard decoiler, each head 13 has a truncated, cone-shaped support 14 which wedges into the bore 21 to prevent relative movement. Because of the wedging action, support 14 causes considerable damage to cone 19 and support 14 generally requires expensive maintenance and repair.

Figure 2:
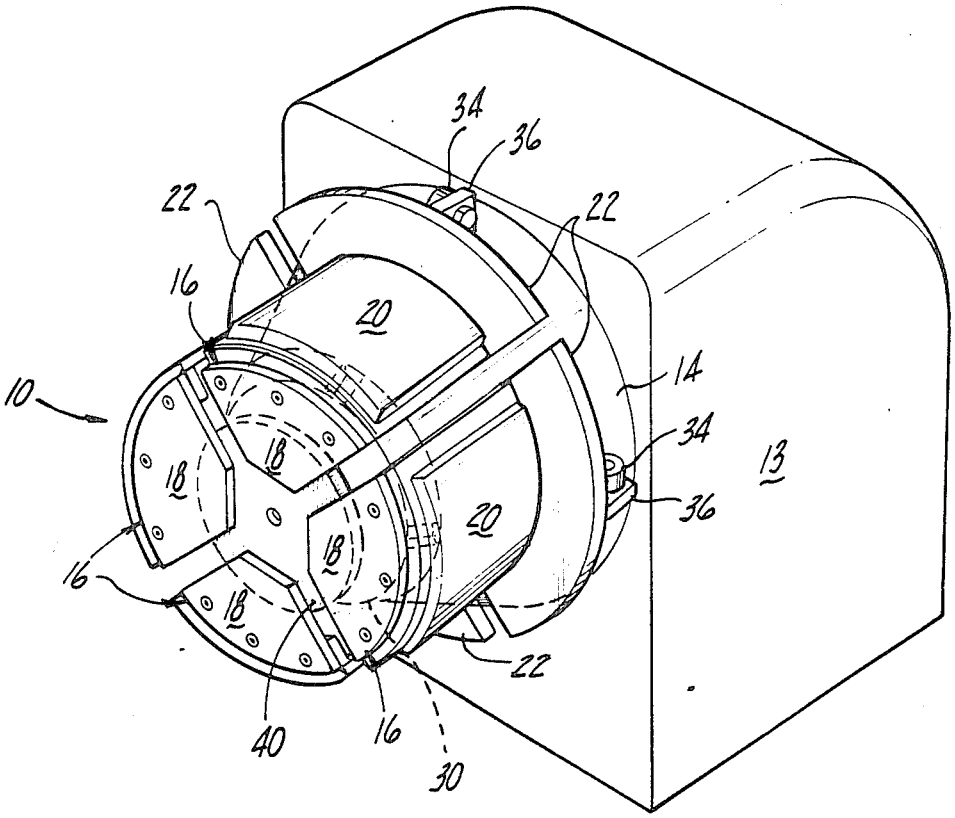
FIG. 2 illustrates a perspective view of the present invention mounted upon a decoiler mechanism having a standard support.

With reference to FIG. 2, the expanding arbor of the present invention is shown generally at 10 mounted on support 14. Arbor 10 has at least two sections 16, with four sections being illustrated, each having a face plate 18 and an elongated, transversely curved side surface 20. A flange 22 is mounted on side surface 30 opposite face plate 18 and extends outwardly away from support 14.

Figure 3:
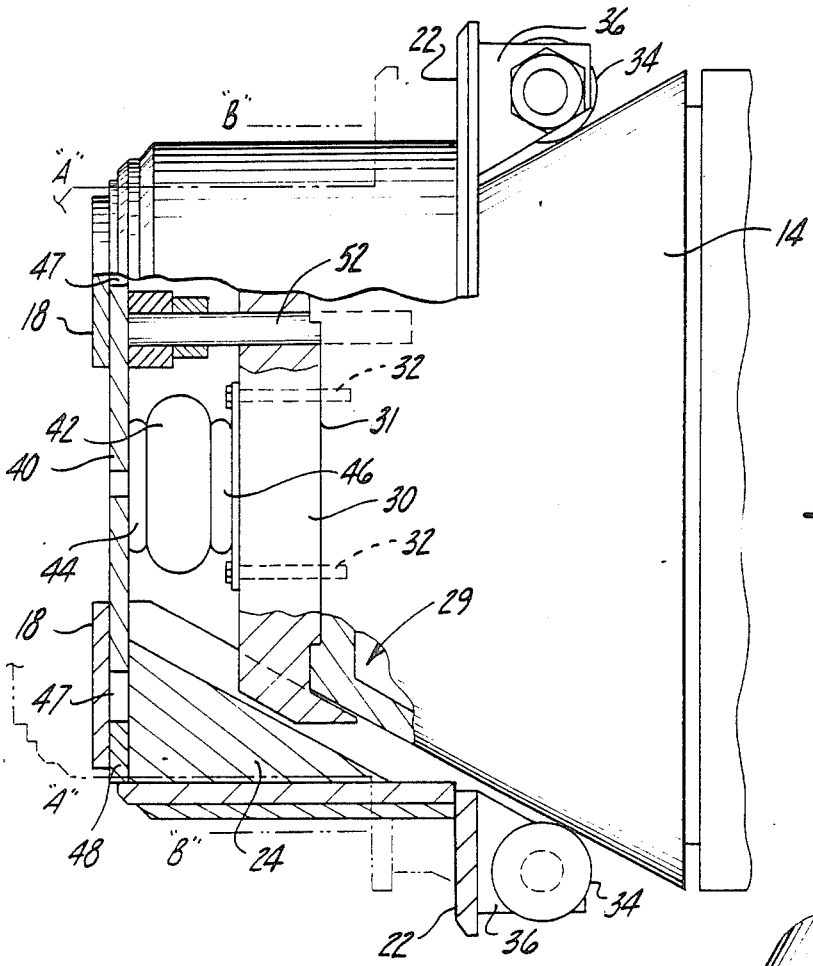
FIG. 3 is a partially cutaway side view of the present invention.

Arbor 10 and support 14 are moved into bore 21 until flange 22 contacts the side of coil 19, stopping further lateral movement of arbor 10 but permitting continued movement of support 14. Further movement of support 14 expands sections 16 outwardly within bore 21. With reference to FIG. 3, the movement of sections 16 is illustrated. Initially, upon entry into the bore, sections 16 are in position A, corresponding to a small diameter. After flange 22 contacts the side of coil 19, sections 16 move radially outwardly and along the length of support 14 to position B, corresponding to a larger diameter that tightly engages the inner walls of bore 21.

Sections 16 are slidably mounted to support 14 by a mounting member 30 and guide and track means 29, see FIG. 3. In the preferred embodiment, member 30 is a steel plate which is mounted to the truncated end of support 14 by bolts 32. To prevent twisting of arbor 10, support 14 and member 30 may be machined as at 31.

Each guide and track means 29 includes a guide 24 having a triangular-shaped tennon 26 and a complementary shaped track 28. Tennon 26 and track 28 interlock in a dove-tail manner permitting interlocking but slidable connection between sections 16 and support 14.

Figure 4:
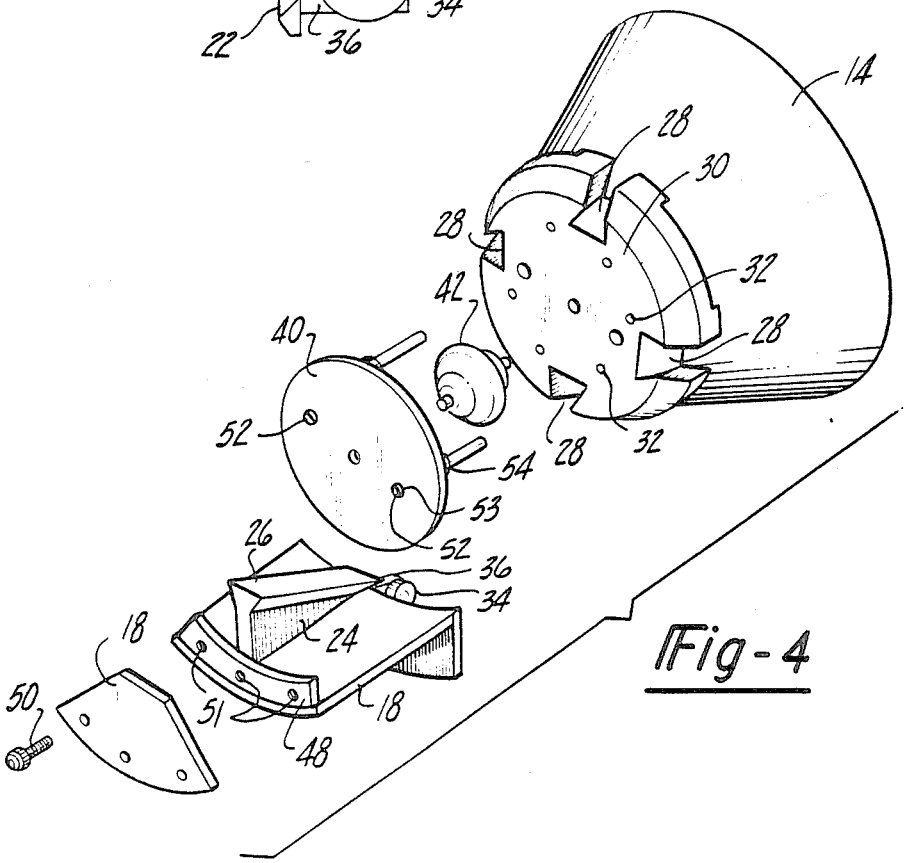
FIG. 4 is a partially exploded view of the present invention.

As illustrated in FIG. 4, guide 24 is sloped in the same direction as the slope of support 14. This common slope permits sections 16 to expand outwardly as support 14 moves inwardly. It is within the intended scope of the present invention to angle track 28 rather than slope guide 24 and also to provide a guide on member 30 and track on surface 18 rather than a guide on surface 18 and track on member 30.

To facilitate the relative movement between sections 16 and support 14, caster wheels 34 are mounted to section 16 and roll along the outer surface of support 14. In the preferred embodiment, casters 34 are mounted by brackets 36 to flanges 22.

An equalizer means 40 is provided to coordinate the movement of sections 16 and return sections 16 to their initial position. Equalizer 40 is mounted to mounting member 30 by a biasing means 42, which in the preferred embodiment is an air spring. Biasing means 42 has opposed mounting plates 44 and 46, with plate 44 being attached to equalizer 40 and plate 46 being attached to member 30. The outer edge of equalizer 40 is slidably received within a cavity 47 formed between face plate 18 and guide 24. Cavity 47 is formed by attaching face plate 18 to a spacer 48. Apertures 51 are provided for receipt of bolts 50 for mounting plate 18 to spacer 48. In this manner, as support 14 is forced between sections 16, biasing means 42 is compressed and sections 16 slide outwardly in a radial direction along equalizer 40. If there is any misalignment of arbor 10 with respect to bore 21, equalizer 40 will ensure that each section 16 expands an equal amount to uniformly engage the bore. Once the material is unwound, spring 42 will force equalizer 40 outwardly and retract sections 16 to position A.

To prevent twisting of equalizer 40, which could damage biasing means 42, guide bars 52 are provided. Bars 52 are fixedly attached to mounting member 30 and are slidably received by openings 53 in equalizer 40. A block and spacer 54 is provided behind member 40 to facilitate sliding action.

In operation, a coil of material 19 is moved by well-known means, such as for example a hydraulically operated platform, to a position between expandable arbors 10. Arbors 10 are then moved laterally inwardly by heads 13 into axial bore 21 until flanges 22 contact the sides of coil 19 preventing further lateral movement of sections 16, but permitting support 14 to move between sections 16, forcing sections 16 radially outwardly into engagement with the walls of bore 21. The interaction of the inner walls of bore 21 and the outer surfaces 20 of sections 16 prevents relative movement without destroying any of the material. After arbors 10 are in place, the platform may be removed and the material unwound.

As should be apparent, the present invention provides an improvement over the standard decoiling mechanism in that it does not destroy the material and sliding surface-to-surface contact is eliminated. Further, arbor 10 can be quickly removed if it must be repaired. Face plates 18 are first removed by removing bolts 50 and then sections 16 are removed from tracks 28. Thereafter, mounting member 30 is removed, by removing bolts 32, from support 14. After removal of arbor 10, the standard cone 14 may be used until arbor 10 is replaced, eliminating unnecessary down-time.

It will be apparent to those skilled in the art that the foregoing disclosure is exemplary in nature rather than limiting, the invention being limited only by the appended claims.

What is claimed is:

1. An expandable arbor adapted for mounting to a standard decoiler mechanism and movable by the decoiler mechanism into the axial bore of a coil of material to rotatably support the coil and allow material to be unwound therefrom, the decoiler mechanism having a coil support means attached thereto with the support means having a forward end, a rearward end and a body which increases in diameter in the direction from the forward end to the rearward end, said expandable arbor comprising:

a mounting member adapted to be mounted to the forward end of the coil support means, the mounting member having at least two circumferentially spaced first guides about the perimeter thereof;

at least two opposed sections, each of the sections having an elongated, transversely curved outer surface with the surfaces being longitudinally positionable within the bore, the sections having second guides substantially complementary to and slidably interconnected with the first guides of the mounting member;

expansion means interconnecting each of the sections, the expansion means permitting movement of the support means with respect to the sections converting lateral movement of the support means into radial expansion of the sections;

whereby the sections are adapted to be laterally moved into the bore by the decoiler mechanism with the sections thereafter expanding radially outwardly into engagement with the bore.

2. The expandable arbor of claim 1, wherein one set of the first and second guides is sloped downwardly in a direction opposite to the direction of lateral movement of the support with the other one of the first and second guides being sloped in the opposite direction.

3. The expandable arbor of claim 1, further comprising a stop means for stopping lateral movement of the sections after substantial insertion of the sections into the bore while simultaneously permitting continued lateral movement of the decoiler mechanism with respect to the sections;

the stop means comprising a flange extending outwardly from each of the surfaces, the flange contacting the side of the coil after a substantial portion of each of the sections has entered the bore.

4. The expandable arbor claim 1, wherein each of the sections includes at least one guide wheel in rolling engagement with the body of the support means to support the sections as the sections slide with respect to the support means.

5. The expandable arbor of claim 1, further comprising:

an equalizer means;

the equalizer means having a face plate mounted to the forward end of the sections opposite the support; and a control plate biasly mounted coaxially with the support, the control plate having a perimeter slidably positioned behind the face plate;

the face plate sliding along the control plate as the sections expand to ensure uniform expansion and retraction of the sections.

6. The expandable arbor of claim 5, wherein the control plate is mounted to the mounting member by registry with at least one guide rod positioned on the mounting member, permitting parallel movement of the control plate relative to the mounting member; and the expandable arbor includes a biasing means mounted between the control plate and mounting member for biasing the relative movement of the control plate.

7. An expandable arbor adapted for mounting to a standard decoiler mechanism and movable by the decoiler mechanism into the axial bore of a coil of material to rotatably support the coil and allow material to be unwound therefrom, the decoiler mechanism having a coil support means attached thereto with the support means having a forward end, a rearward end and a body which increases in diameter in the direction of the rearward end, said expandable arbor comprising:

a mounting member adapted to be mounted to the forward end of the coil support means, the mounting member having at least two circumferentially spaced guides about the perimeter thereof;

at least two opposed sections slidably mounted to the mounting member, said sections having second guides substantially complementary to and slidably interconnected with the first guides of said mounting member;

stop means for stopping lateral movement of said sections after substantial insertion of said sections into said bore while simultaneously permitting continued lateral movement of said decoiler mechanism with respect to said sections;

a control plate slidably mounted to the mounting member;

face plates mounted to the forward end of each of said sections and slidably engaging the perimeter of said control plate, said face plates sliding along said control plate as said sections expand to ensure uniform expansion and retraction of said sections.

8. The expandable arbor of claim 7, wherein said control plate is mounted to said mounting member by registry with at least one guide rod permitting parallel movement of the control relative to the mounting member, with a biasing means mounted between said control plate and mounting member for biasing the relative movement of said control plate.

9. The expandable arbor of claim 7, wherein said sections each include at least one guide wheel in rolling engagement with said body of said support means to support said section as said section slides with respect to said support means.

10. An expandable arbor removably mounted on a standard cone decoiler mechanism and movable by said cone decoiler mechanism into the axial bore of a coil of material to rotatably support said coil and allow material to be unwound therefrom, said expandable arbor comprising:

at least two opposed sections, each of said sections having an elongated, transversely curved outer surface, said surfaces being longitudinally positionable within said bore;

expansion means interconnecting each of said sections to said decoiler mechanism, said expansion means permitting movement of said decoiler mechanism with respect to said sections and converting lateral movement of said decoiler mechanism into radial expansion of said sections;

stop means for stopping lateral movement of said sections after substantial insertion of said sections into said bore while simultaneously permitting continued lateral movement of said decoiler mechanism with respect to said sections;

an equalizer means having a face plate mounted to the forward end of said sections opposite said decoiler mechanism and a control plate biasly mounted coaxially with said decoiler mechanism, said control plate having a perimeter slidably positioned behind said face plate, said face plate sliding along said control plate as said sections expand to ensure uniform expansion and to retract said sections after said stop means is released;

whereby said sections are laterally moved into said bore by said decoiler mechanism until said stop means prevents further movement of said sections, said sections thereafter expanding radially outwardly into engagement with said bore.

11. The expandable arbor of claim 10, wherein said stop means comprises a flange extending outwardly from each of said outer surfaces, said flange contacting the side of said coil after a substantial portion of each of said sections has entered said bore.

12. The expandable arbor of claim 10, wherein said expansion means includes a track and guide, one of which is sloped downwardly in a direction opposite to the direction of lateral movement of said support and the other one of which is sloped in the opposite direction.

13. The expandable arbor of claim 12, wherein said guide includes a triangular-shaped tennon and said track includes a complementary slot;

said tennon being slidably received by said slot in a dove-tail relationship permitting interlocking but slidable connection between said sections and said decoiler mechanism.

* * * * *